United States Patent [19]

Matt

[11] Patent Number: 4,884,377

[45] Date of Patent: Dec. 5, 1989

[54] REMOVABLE TENSION MEMBER

[75] Inventor: Peter Matt, Ittigen, Switzerland

[73] Assignee: VSL International AG., Bern, Switzerland

[21] Appl. No.: 320,843

[22] Filed: Mar. 6, 1989

Related U.S. Application Data

[63] Continuation of Ser. No. 41,535, Apr. 23, 1987, abandoned.

[30] Foreign Application Priority Data

Apr. 28, 1986 [CH] Switzerland ..... 1721/86

[51] Int. Cl.[4] ..... E04B 1/38; E02D 5/80

[52] U.S. Cl. ..... 52/98; 52/223 L; 52/230; 52/698; 405/259

[58] Field of Search ..... 52/230, 223 R, 166, 52/98; 405/259, 288, 260; 24/115 M, 122.6; 403/371, 2; 57/202

[56] References Cited

U.S. PATENT DOCUMENTS

| | | | |
|---|---|---|---|
| 2,943,434 | 7/1960 | Joy | 57/202 |
| 2,959,436 | 11/1960 | Duda | 24/122.6 |
| 3,355,542 | 11/1967 | Finn | 57/202 |
| 3,356,397 | 12/1967 | Bagby | 57/202 |
| 3,844,697 | 10/1974 | Edwards | 52/223 R |
| 3,921,353 | 11/1975 | Howlett | 52/223 R |
| 3,936,256 | 2/1976 | Howlett | 52/223 R |
| 3,936,924 | 2/1976 | Ichise | 405/259 |
| 4,363,462 | 12/1982 | Wlodkowski | 52/230 |
| 4,604,003 | 8/1986 | Francoeur | 52/726 |

FOREIGN PATENT DOCUMENTS

| | | |
|---|---|---|
| 2627524 | 5/1978 | Fed. Rep. of Germany . |
| 3039080 | 4/1982 | Fed. Rep. of Germany . |

*Primary Examiner*—John E. Murtagh

*Attorney, Agent, or Firm*—Oldham & Oldham

[57] ABSTRACT

In order to make a tension member (1) substantially removable from the ground or from a structure, a central element (2) thereof is completely severed. If the tension member is to be further weakened, at least one outer element (3) is also severed besides the central element. A supporting contrivance (5) is applied to the tension member either around the point of separation (4) of the central element or around both points of separation (4, 6) of the central element and of the outer element. By application of a load, the tension member is torn apart near the point or points of separation so that the major part of the tension member can be pulled out of the ground or structure and, if need be, reused.

16 Claims, 6 Drawing Sheets

REMOVABLE TENSION MEMBER

Figure 1:
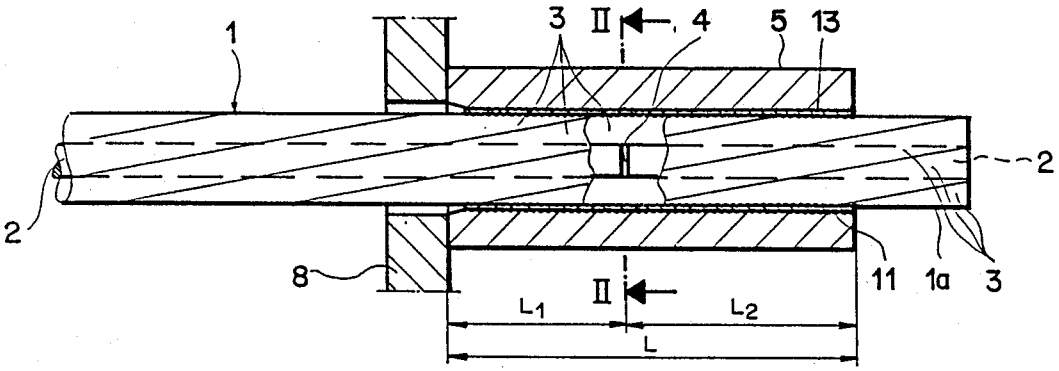

This is a continuation of co-pending application Ser. No. 041,535 filed on Apr. 23, 1987, now abandoned.

This invention relates to construction work, and more particularly to a method of making a tension member to be anchored in the ground or in a structure and subjected to a load, and composed of a central element and a plurality of outer elements disposed concentrically relative to the central element, this tension member being intended to be removed for the most part from the ground or the structure after use. The invention further relates to a tension member made by this method.

In the building of structures which, for example, extend several floors down into the earth, the excavations are often enclosed by subterraneous curtains or sheet piling which is anchored at the back by soil or rock anchors having tension members. The tension members are anchored in the ground and subjected to a load by prestressing. The tension members may also be used in the structures themselves, as in the case of bridge supports, for instance. There, during construction of the bridge, the supports may be subjected to forces which necessitate their temporary reinforcement by means of tension members.

After use, the tension members are removed from the ground or from the structure and may possibly be reused. In many countries, there are ordinances requiring that the soil or rock anchors be removed when construction is ended. For partially or completely removing the tension members from the ground or structure, recourse may be had to mechanical, physical, chemical, or other means.

In mechanical removal, the principle of a predetermined breaking location on the tension member may be applied, for example. By means of the predetermined breaking location, a reduction of cross-sectional area of the tension member is achieved. This method is usually limited to bar-shaped steel tension members having a single tension bar. The tension member is torn apart at the breaking location by overstressing beyond the tensile strength and is for the most part removed from the ground or from the structure.

West German Disclosed Application (DOS) No. 30 39080 describes a retrievable reinforcing element for a soil or rock anchor. The tension member for such an anchor consists of two or more steel bars. The basic concept of this prior art solution is to embed the individual steel bars of the tension member in the anchor body in spread-apart form by disposing spacers between these bars. By pulling out or destroying the detachably inserted spacers, a clearance space is created for the individual steel bars. Upon applying traction from the downstream anchoring end and overcoming the shear bond of the bars to the anchor body, the bars are pulled out of the anchor one after the other and thus retrieved.

In West German Pat. No. 2,627,524, a soil or rock anchor having a tension member surrounded by a casing pipe is disclosed. The tension member in the form of a steel-wire rope extends through the casing pipe and is slidingly disposed therein. The upstream end of the tension member is led through an anchor body and held by means of a sleeve braced against the anchor body. The basic concept of this solution is that an adhesive is applied as an intermediate layer between the sleeve and the tension member and firmly pressed against the tension member by the sleeve. The gripping force of the sleeve is such that the maximum traction needed to pull the tension member out is somewhat greater than the force exerted upon the tension member in use.

The two prior disclosures discussed above relate only to a soil or rock anchor. The main disadvantage of the removable anchor described in DOS No. 30 39080 is that spacers must be inserted in the anchor with the tension member and subsequently pulled out again, thus complicating and hence increasing the cost of the anchor. In West German Pat. No. 2,627,524, an adhesive is disposed between the outside surface of the tension member and the bore of the gripping sleeve and must be of such nature that the loading capacity really is situated between the working load and the breaking strength; however, the manufacturing tolerance is very small, and any inaccuracy may increase the instability factor in the loading capacity of the soil or rock anchor.

It is an object of this invention to provide an improved method of making a removable tension member by simple means, wherein the load needed for removing the tension member can be calculated in advance.

A further object of this invention is to provide a tension member which may be utilized not only in soil or rock anchors but also for other purposes.

To this end, in the method according to the present invention, at least the central element of the tension member is completely severed in the region of the part of it to be anchored, and a supporting means is thereafter applied to the tension member around the point of separation through application thereabout by pressure.

In the tension member according to the present invention, having in the region of the part of it to be anchored a completely severed central element and a supporting means applied to the tension member around the point of separation through application thereabout by pressure, the position of the point of separation of the central element is determinable according the the magnitude of the load to be exerted on the tension member in the region of the part of the tension member to be anchored.

At least one outer element should preferably be severable in addition to the central element. When an outer element is severed in the region of the part of the tension member to be anchored, a supporting means is applied to the tension member by being clamped around the points of separation of both the central element and the outer element.

Figure 2:
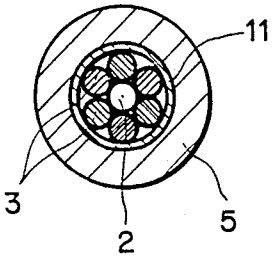
Figure 3:
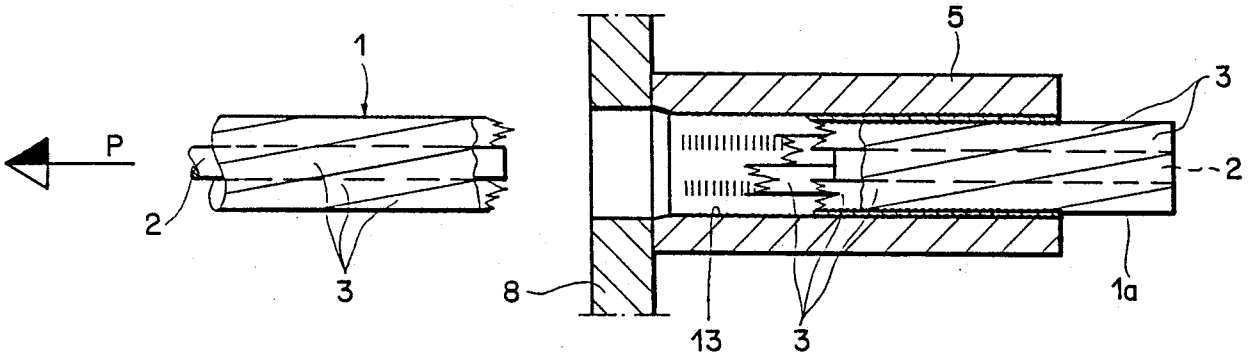
Figure 4:
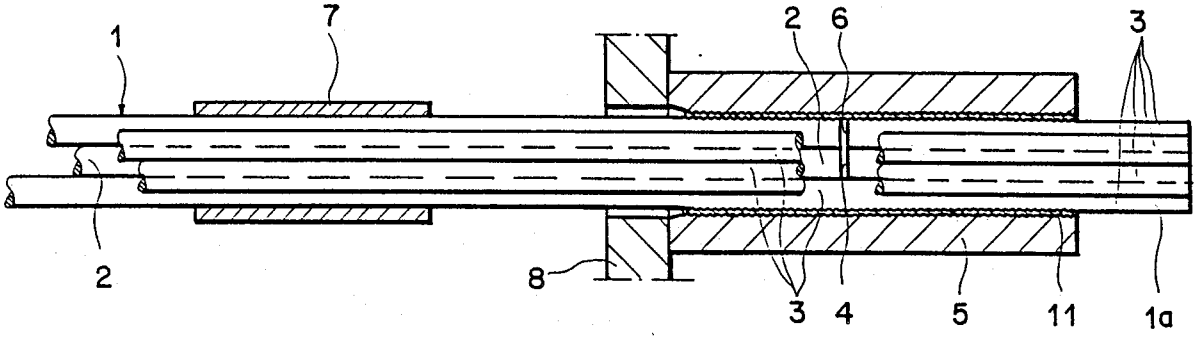
Figure 5:
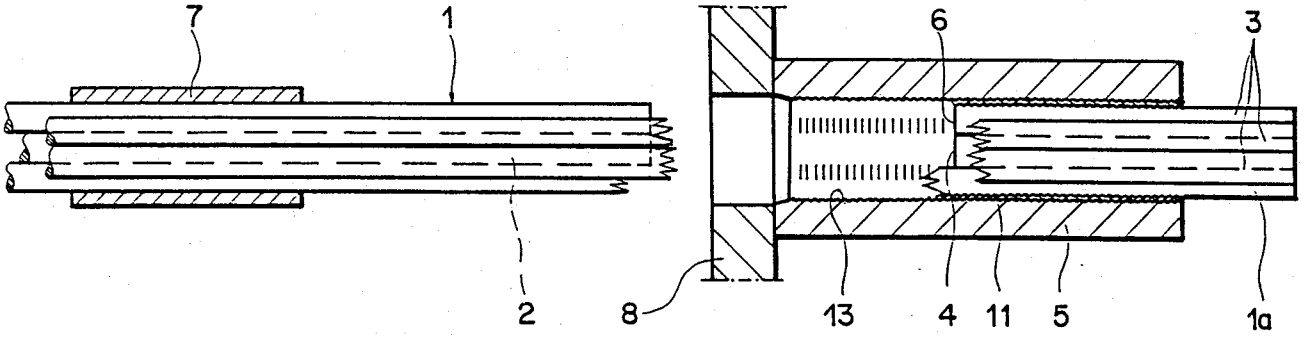
Figure 6:
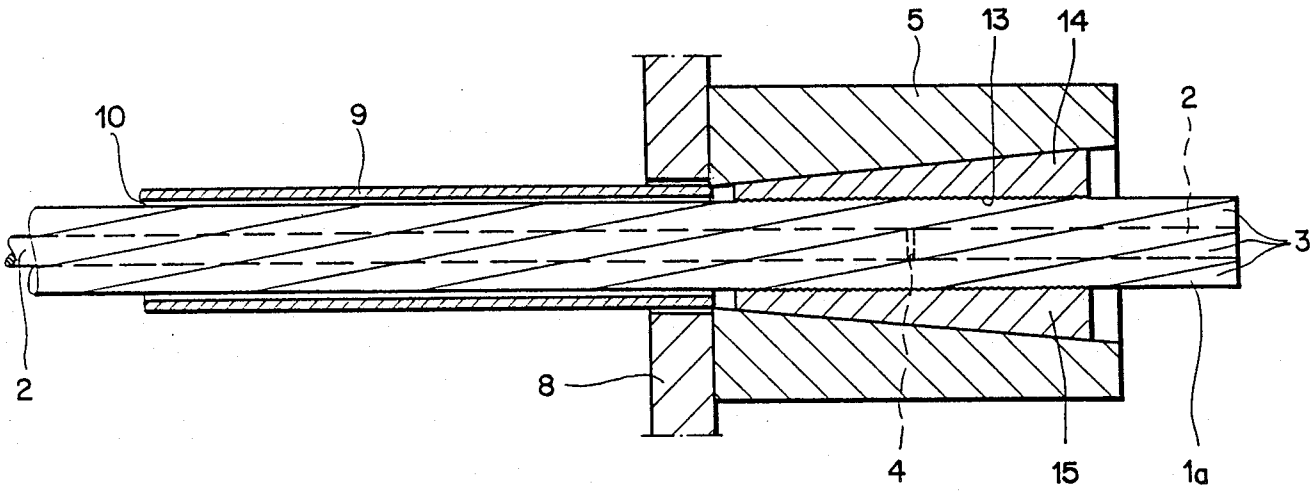
Figure 7:
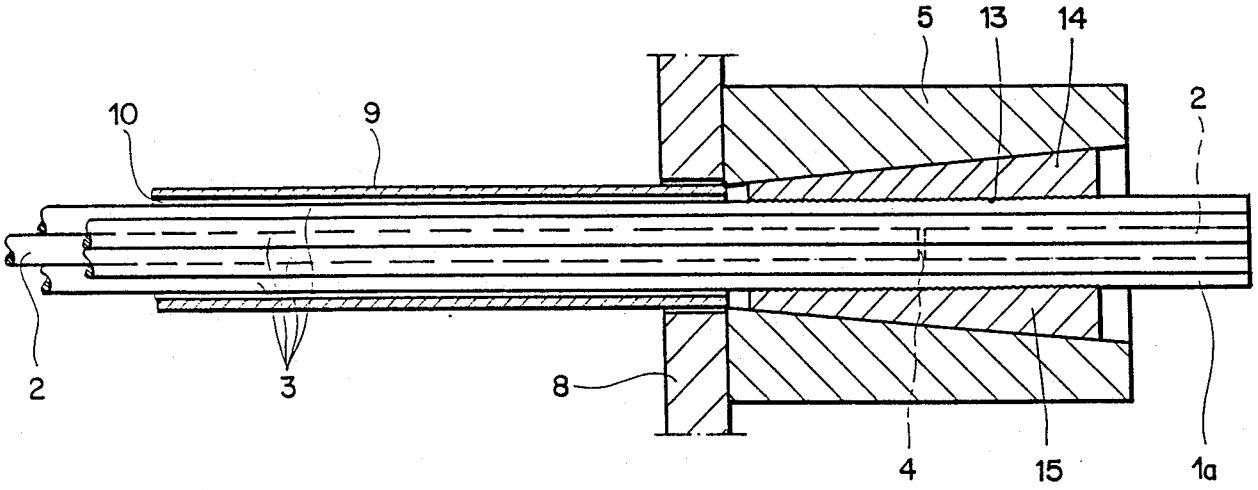
Figure 8:
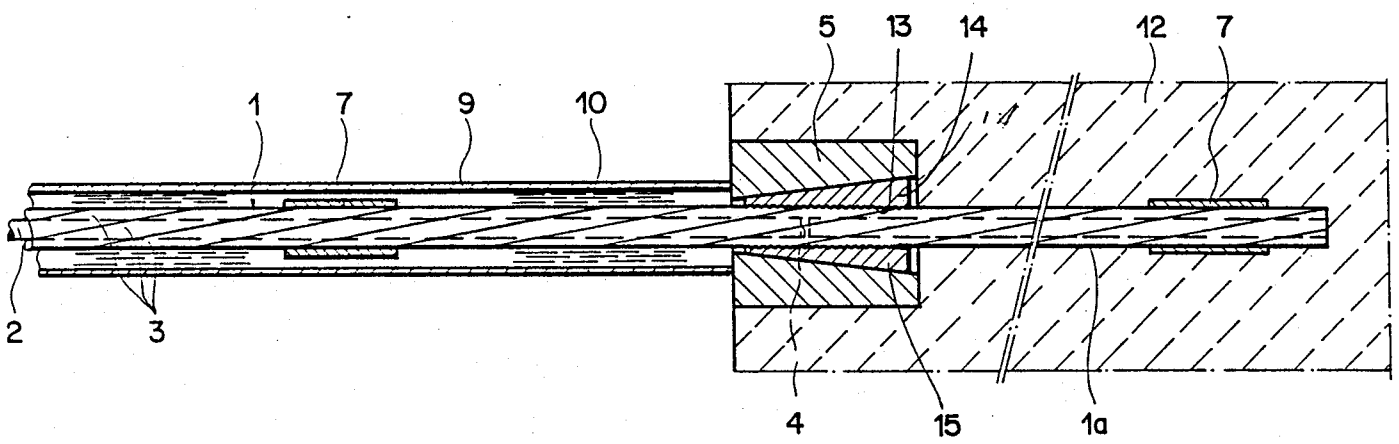
Figure 9:
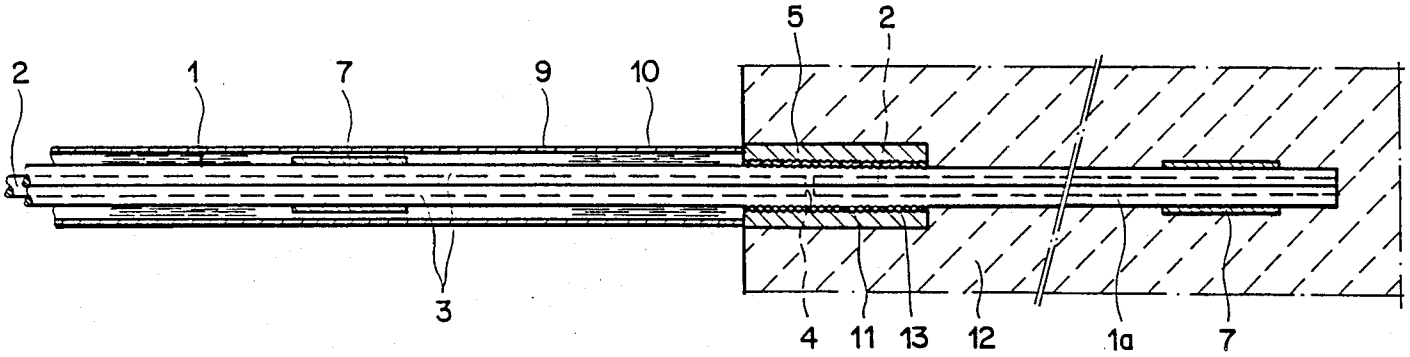
Figure 10:
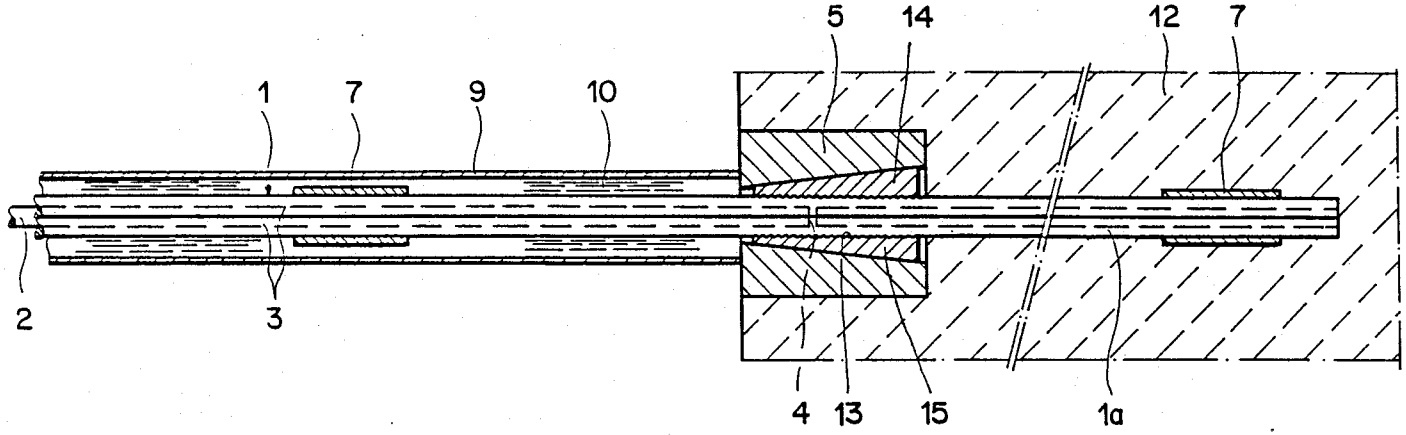

Preferred embodiments of the invention will now be described in detail with reference to the accompanying drawings, in which:

FIG. 1 is a partial sectional view of a tension member consisting of a steel-wire rope, the central element of which has been completely severed, having a supporting means clamped around the point of separation, FIG. 2 is a cross-section of the tension member taken on the line II—II of FIG. 1, FIG. 3 is a partial sectional view of the tension member of FIG. 1 which has been torn apart near the point of separation of the central element, FIG. 4 is a partial sectional view of a tension member consisting of a central bar and a plurality of concentrically disposed parallel steel bars, the central element and one outer element of which tension member have been severed, having a supporting means clamped around both points of separation, FIG. 5 is a partial sectional view of the tension member of FIG. 4 which has been torn apart near the two points of separation, FIG. 6 is a partial sectional view of a tension member consisting of a steel-wire rope, the central element of which has been severed, having a supporting means acting as a clamping wedge clamped around the point of separation, FIG. 7 is a partial sectional view similar to FIG. 6 but with the tension member consisting of a central bar and a plurality of concentrically disposed parallel stel bars, FIG. 8 is a partial sectional view of the tension member of FIG. 6, having a supporting means acting as a clamping wedge clamped around the point of separation, the part of the tension member to be anchored being extended, FIG. 9 is a partial sectional view of the tension member of FIG. 7, having a supporting means in the form of a sleeve clamped around the point of separation, the part of the tension member to be anchored being extended, and FIG. 10 is a partial sectional view of the tension member of FIG. 9, having a supporting means acting as a clamping wedge.

According to the present invention, the procedure is as follows for making a tension member 1, composed of a central element 2 and a plurality of outer elements 3 disposed concentrically thereto, intended to be anchored in the ground or in a structure, subjected to a load, and substantially removed from the ground or the structure after use: in a zone L (FIG. 1) of the part 1*a* of tension member 1 to be anchored, central element 2 is severed. The tension member 1 of FIG. 1 consists of a steel-wire rope. In this case, the outer elements 3 of stranded wire are spread apart, and through the opening thus produced the central element 2, also of wire, is sawn through. If tension member 1 consists of a central steel bar and a plurality of parallel outer steel bars disposed concentrically to the central bar, central element 2 consisting of the central steel bar is sawn or cut through before tension member 1 is assembled.

After central element 2 has been severed, a supporting means 5 is clamped around the point of separation 4. The supporting means 5 depicted in FIGS. 1, 3, 4, 5, and 9 is a sleeve clamped around tension member 1 in zone L of part 1*a*, whereas in FIGS. 6 and 8, supporting means 5, together with two wedge-shaped parts 14 and 15 disposed therein, act as a clamping wedge. The surfaces of inner wedge-shaped parts 14 and 15 resting against tension member 1 are provided with teeth 13. FIG. 9 shows a lining 11 provided between the inside bore of clamping sleeve 5 and the circumference of outer elements 3, this lining being made of a material harder than that of sleeve 5 and tension member 1.

Central element 2 is always severed, and if it is desired to reduce the load necessary for removing tension member 1, one or more of the outer elements 3—but in no event all of them—are also severed. At least one outer element 3 is severed in zone L, somewhere near point of separation 4 of central element 2. Then, as described above, a supporting means 5 is clamped around tension member 1 in the region of point of separation 4 of central element 2 and point of separation 6 of the severed outer element 3.

It is possible, however, to sever at least one outer element 3 outside zone L. In that case, supporting means 5 is placed only around point of separation 4 of central element 2, while point of separation 6 of the severed outer element 3 remains without any supporting means.

In the tension member 1 made by the steps described above, the position of point of separation 4 of central element 2 can be fixed according to the magnitude of the load P to be exerted on zone L of tension member 1 during its removal. When the distance $L_1$ between point of separation 4 of central element 2 and the end of zone L, measured in a first end direction of force of load P, is less than the distance $L_2$ between the other or second end of zone L and the point of separation 4 measured in the direction of the applied load P, the magnitude of the load P to be exerted will be less than if $L_2$ were less than $L_1$. In the critical range where $L_1=L$ and $L_2=0$, the maximum required magnitude of the load to be exerted for removing tension member 1 will be close to the breaking load of the intact tension member 1, without points of separation. Therefore, load P must be kept as small as possible, but greater than the required working load; one or more of the outer elements 3 of tension member 1 can then also be severed in the vicinity of supporting means 5.

The load to be exerted for removing the assembled tension member 1 will be situated in the following critical range: required working load < load P to be exerted for removing the tension member < breaking load of intact tension member.

FIGS. 1 and 3–7 show an abutment 8 against which the outer end of supporting means 5 is braced. Abutment 8 has the same function as the anchor body of a soil or rock anchor. FIGS. 6–10 show the active part of tension member 1 disposed in a protective pipe 9, the clearance space being filled with a lubricant 10.

The embodiments of FIGS. 8–10 have an extended passive part 1*a* (the part of tension member 1 to be anchored) still anchored in a concrete body 12 behind supporting means 5. Outside zone L, clamping sleeves 7 are shown on the parallel outer steel bars 3 disposed concentrically about center bar 2. Sleeves 7 press bars 3 against central bar 2 and hold them all together. Here an abutment is superfluous because concrete body 12 exerts a sufficient hold on supporting means 5 and passive part 1*a*.

Upon application of a load exceeding the tensile strength, all the non-severed outer elements 3 of such a tension member 1 break in the vicinity of the supporting means 5, so that the major part of the tension member can, if necessary, be removed from the ground or the structure for reuse. The magnitude of the load will be ascertained as a function of the ratio $L_1:L_2$.

What is claimed is:

1. A tension member to be anchored in the ground or in a structure, comprising:

a central element, a plurality of further elements surrounding the central element, at least the central element being completely severed in a predetermined zone thereof, to form a point of separation, and a supporting means applied around the tension member at said predetermined zone, wherein the distance to the point of separation of said central element from the end of said predetermined zone measured in the direction of an applied load is fixed according to the magnitude of the load to be exerted on said predetermined zone for removal of said tension member from an anchored position.

2. The tension member of claim 1, wherein at least one of said plurality of outer elements is completely severed while at least one of said plurality of outer elements remains intact.

3. The tension member of claim 2, wherein said at least one of said plurality of outer elements is completely severed within said predetermined zone.

4. The tension member of claim 2, wherein said at least one of said plurality of outer elements is completely severed outside of said predetermined zone.

5. The tension member of claim 1, wherein said supporting means is a sleeve clamp around the tension member in said predetermined zone.

6. The tension member of claim 1, wherein said supporting means is a sleeve clamped around the tension member at said predetermined zone and includes a plurality of wedge-shaped means disposed therein acting as a clamping wedge on said central element and said plurality of outer elements.

7. The tension member as in claim 6, wherein the inner surfaces of said plurality of wedge-shaped means resting against the tension member are provided with teeth.

8. The tension member of claim 1, wherein said supporting means comprises a sleeve clamped around the tension member in said predetermined zone and a lining of a harder material than said sleeve disposed between said sleeve and said plurality of outer elements of said tension member.

9. The tension member as in claim 1, wherein said end of said supporting means measured in the direction of an applied load is braced against an abutment means used as an anchor body.

10. The tension member of claim 1, wherein said tension member is provided with a protective pipe means extending from said predetermined zone in the direction of an applied load and having a lubricant disposed in said protection pipe means.

11. The tension member of claim 1, wherein said tension member extends beyond said predetermined zone in a direction opposite to an applied load for anchoring into the ground or in a structure.

12. The tension member of claim 1, wherein said central element forms part of a steel-wire rope.

13. The tension member of claim 1, wherein said central element is a central steel bar, further comprising a plurality of parallel outer steel bars disposed concentrically about said central steel bar.

14. The tension member of claim 1, wherein said central element is a central steel bar, further comprising a plurality of parallel outer steel bars disposed concentrically about said central steel bar and one or more clamping sleeves disposed around said outer steel bars outside said predetermined zone for pressing said outer steel bars against said central steel bar.

15. A tension member to be anchored in the ground or in a structure and which is intended to be removed from the ground or structure after use, comprising:

a central element being completely severed at a predetermined point of separation, a plurality of outer elements surrounding said central element around said point of separation, a supporting means applied around the tension member at a predetermined zone relative to said point of separation wherein the distance between said point of separation of said central element and the end of said predetermined zone measured in the direction of an applied load is fixed according to the magnitude of the load to be exerted for removing said tension member in a range between a required working load of said tension member and the breaking load of a tension member without said point of separation.

16. A tension member to be anchored in the ground or in a structure and subsequently removed therefrom for further use, comprising:

a central element and a plurality of outer elements surrounding said central element, at least said central element being completely severed to form a point of separation, and a supporting means applied around said central element and said plurality of outer elements at a predetermined zone relative to said point of separation, wherein a first distance from said point of separation of said central element to a first end of said predetermined zone measured in the direction of an applied load is fixed relative to a second distance to the point of separation of said central element from a second end of said predetermined zone measured in the direction of said applied load wherein the magnitude of said applied load necessary to remove said tension member is determined as a function of the ratio of said first and second distances.

* * * * *